US011173991B1

(12) United States Patent
Livermore

(10) Patent No.: US 11,173,991 B1
(45) Date of Patent: Nov. 16, 2021

(54) STABILIZER WITH AT LEAST ONE SHOCK ABSORBER

(71) Applicant: Michael A Livermore, Charlottesvile, VA (US)

(72) Inventor: Michael A Livermore, Charlottesvile, VA (US)

( * ) Notice: Subject to any disclaimer, the term of this patent is extended or adjusted under 35 U.S.C. 154(b) by 0 days.

(21) Appl. No.: 17/320,390

(22) Filed: May 14, 2021

(51) Int. Cl.

| | |
|---|---|
| ***B63B 39/00*** | (2006.01) |
| ***B63B 39/02*** | (2006.01) |
| ***B63B 39/06*** | (2006.01) |
| *E02B 3/06* | (2006.01) |

(52) U.S. Cl.
CPC ..... *B63B 39/02* (2013.01); *B63B 39/062* (2013.01); *E02B 3/064* (2013.01)

(58) Field of Classification Search
CPC ..... B63B 39/005; B63B 39/02; B63B 39/06; B63B 39/062; B63B 2039/067
See application file for complete search history.

(56) References Cited

U.S. PATENT DOCUMENTS

| | | | | |
|---|---|---|---|---|
| 2,561,539 | A * | 7/1951 | Seward | B63B 39/062 114/126 |
| 3,260,232 | A * | 7/1966 | Douglas | B63B 39/062 114/126 |
| 3,330,241 | A | 11/1967 | Stephanou | |
| 3,589,324 | A | 6/1971 | Hoffman | |
| 3,952,680 | A * | 4/1976 | Griffin | B63B 39/06 114/123 |
| 4,102,287 | A | 7/1978 | Ferris | |
| 4,905,622 | A * | 3/1990 | Silvia, Jr. | B63B 39/062 114/122 |
| 5,144,904 | A | 9/1992 | Weldon | |
| 5,263,434 | A | 11/1993 | Mashburn | |
| 6,659,032 | B1 | 12/2003 | Simon | |
| 7,644,674 | B1 | 1/2010 | Goldston | |
| 2020/0070936 | A1 | 3/2020 | Ward | |

FOREIGN PATENT DOCUMENTS

| | | | | |
|---|---|---|---|---|
| DE | 29613752 | U1 * | 10/1996 | B63B 39/062 |

* cited by examiner

*Primary Examiner* — Andrew Polay
(74) *Attorney, Agent, or Firm* — Glushko-Samuelson Intellectual Property Law Clinic

(57) ABSTRACT

A movable structure comprises a spar having a central portion, a first end portion, and a second end portion. A first tow line may connect between the first end portion of the spar and a first resistance device. A second tow line may connect between the second end portion of the spar and a second resistance device. A first shock absorber may connect between the spar and a first side of a movable structure. A second shock absorber may connect between the spar and a second side of a movable structure.

20 Claims, 4 Drawing Sheets

STABILIZER WITH AT LEAST ONE SHOCK ABSORBER

BRIEF DESCRIPTION OF THE SEVERAL VIEWS OF THE DRAWINGS

Non-limiting examples of embodiments of the disclosure are described below with reference to figures attached hereto that are listed following this paragraph. Similar structures, elements, or parts that appear in more than one figure are generally labeled with a similar numeral in other figures in which they appear. Dimensions of components and features shown in the figures are chosen for convenience and clarity of presentation and are not necessarily shown to scale.

DETAILED DESCRIPTION OF EMBODIMENTS

The present disclosure relates generally to the field of stabilizing devices for various types of vessels and other movable objects. Specific embodiments related to monohull watercraft are disclosed to teach the basic concept of stabilizing devices. However, the concepts disclosed are broader and may be applied to various other movable objects such as multi-hull boats, canoes, pontoons, unmanned aerial vehicles, docks, towers, and/or the like.

Ocean swells can cause watercraft to roll. Some watercraft are designed to stabilize on their own, such as trimarans. Some watercraft have stabilizing devices installed. Some of the stabilizing devices utilize resistance devices that are attached to the watercraft in various ways. However, stabilizing devices can exert a considerable amount of strain on portions of the watercraft when counteracting ocean swell movements, which can cause significant damage to the watercraft.

In addition, some current stabilizing devices may encroach on the inherently limited deck space on many watercraft, including monohull boats.

Features herein relate to the considerable amount of strain stabilizing devices can exert on portions of a watercraft. In an example, a shock absorber may be incorporated in a stabilizing device. A shock absorber may reduce strain on a mast, or similar elongated portion, of a watercraft and redirect it to a side of a watercraft. This may reduce possible damage a stabilizing device can cause to a watercraft by transferring the strain to a more durable and stronger part of the watercraft.

In an example, a platform structure may be configured to one or more sides of a watercraft. This may increase deck space of a watercraft that utilizes the teachings of the present disclosure, while still counteracting ocean swells that may cause the watercraft to roll.

Figure 1:
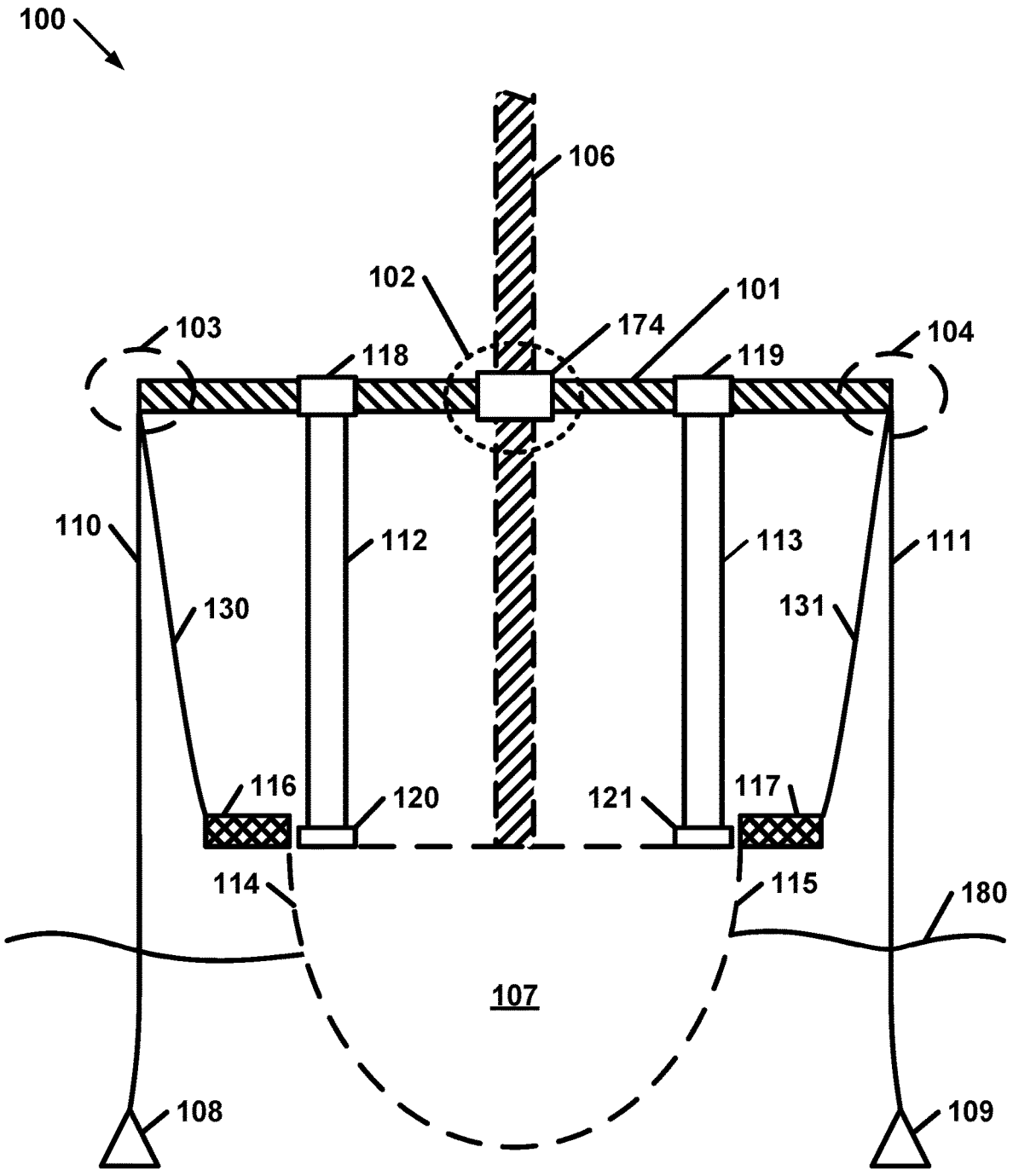
FIG. 1 illustrates a front view of an aspect of an example embodiment of the present disclosure.

FIG. 1 illustrates a front view of an example apparatus 100 comprising a stabilizer on a movable structure (e.g. watercraft). At least one shock absorber (e.g. 112 and/or 113) may help at least one resistance device (e.g. 108 and/or 109) stabilize a watercraft or other movable structure (e.g. 107). The apparatus 100, as illustrated, comprises a spar 101 having a central portion 102, a first end portion 103, and a second end portion 104. The apparatus 100 may comprise a first tow line 110 connected between the first end portion 103 of the spar 101 and a first resistance device 108. A second tow line 111 may be connected between the second end portion 104 of the spar 101 and a second resistance device 109. The apparatus 100 may comprise a first shock absorber 112 connected between the spar 101 and the first side 114 of the movable structure 107. The apparatus 100 may comprise a second shock absorber 113 connected between the spar 101 and the second side 115 of the movable structure 107.

According to an embodiment, a movable structure 107 may move due to an external force(s). The movable structure 107 may comprise, but is not limited to, a watercraft, a dock, a floating platform, a canoe, a pontoon, or similar apparatus that may be (or become) unstable due to water movements. The movable structure 107 may also comprise, but is not limited to, an aircraft, flying device, or similar apparatus that may be (or become) unstable due to air movement. The movable structure 107 may also comprise, but is not limited to, an apparatus that may be (or become) unstable due to another external force(s).

A movable structure 107 may comprise multiple parts. An embodiment of a movable structure 107 may comprise a first side 114 and a second side 115. The first side 114 and the second side 115 may be opposite portions of the movable structure 107. According to other embodiments, the first side 114 and the second side 115 may comprise different portions of a non-symmetric structure. According to other embodiments, the concepts introduced herein may be applied to movable structures with more than two sides.

A spar 101 may transfer the external force(s) to a first shock absorber 112 and/or a second shock absorber 113 attached to the movable structure 107. The spar 101 may be rigid enough to withstand an external force(s), but flexible enough to avoid fracturing. An external force could be applied by pressure from relative movement of water 180, air, and/or the like. According to an embodiment, the spar 101 may comprise a beam. According to an embodiment, the spar 101 may comprise a pole. According to an embodiment, the spar 101 may comprise a rod. According to an embodiment, the spar 101 may comprise wood. According to an embodiment, the spar 101 may comprise metal. According to an embodiment, the spar 101 may comprise a polymer material. According to an embodiment, the spar 101 may comprise carbon fiber. According to an embodiment, the spar 101 may comprise combinations of materials, such as, for example, at least two or more of: wood, metal, polymer material, carbon fiber, combinations thereof, and/or the like.

A spar 101 may comprise multiple portions. An embodiment of the spar 101 may comprise a central portion 102, a first end portion 103, and a second end portion 104. The central portion 102 may comprise a middle section of a continuous spar 101. The central portion 102 may also comprise a section where spar(s) 101 are connected. The first end portion 103 and the second end portion 104 may be opposite end portions of a continuous spar 101. The first end portion 103 and the second end portion 104 may comprise the end portions of multiple spars 101 opposite the central portion 102.

A first resistance device 108 and a second resistance device 109 may be substantially similar. Substantially similar means that the first resistance device 108 and/or the second resistance device 109 may appear identical and/or may be complimentary pieces with respect to shape, dimension, size, and/or material. Substantially similar may mean the first resistance device 108 and/or the second resistance device 109 may operate in a similar capacity within the overall apparatus 100. The first resistance device 108 and/or the second resistance device 109 may provide the counteracting force(s) to the external force(s) that cause the movable structure 107 to move. The first resistance device 108 and/or the second resistance device 109 may comprise paravanes, plated stabilizers, hinged-wing stabilizers, finned stabilizers, anchors, moorings, combinations thereof, or other stabilizer design(s). According to an embodiment, the first resistance device 108 and/or the second resistance device 109 may comprise plastic. According to an embodiment, the first resistance device 108 and/or the second resistance device 109 may comprise wood. According to an embodiment, the first resistance device 108 and/or the second resistance device 109 may comprise metal. According to an embodiment, the first resistance device 108 and/or the second resistance device 109 may comprise rubber. According to an embodiment, the first resistance device 108 and/or the second resistance device 109 may comprise a polymer material. According to an embodiment, the first resistance device 108 and/or the second resistance device 109 may comprise carbon fiber. According to an embodiment, the first resistance device 108 and/or the second resistance device 109 may comprise combinations of materials, such as, for example, at least two or more of: plastic, wood, metal, rubber, polymer material, carbon fiber, combinations thereof, and/or the like.

A first tow line 110 and a second tow line 111 may be substantially similar. Substantially similar means that the first tow line 110 and/or the second tow line 111 may appear identical and/or may be complimentary pieces with respect to shape, dimension, size, and/or material. Substantially similar may mean the first tow line 110 and/or the second tow line 111 may operate in a similar capacity within the overall apparatus 100. The first tow line 110 may transfer the counteracting forces from the first resistance device 108 to the first end portion 103 of the spar 101. The second tow line 111 may transfer the counteracting forces from the second resistance device 109 to the second end portion 104 of the spar 101. The first tow line 110 may comprise a material configured to bear the counteracting forces from the first resistance device 108 without breaking or fraying. The second tow line 111 may comprise a material configured to bear the counteracting forcers from the second resistance device 109 without breaking or fraying. According to an embodiment, the first tow line 110 and/or the second tow line 111 may comprise plastic. According to an embodiment, the first tow line 110 and/or the second tow line 111 may comprise rope. According to an embodiment, the first tow line 110 and/or the second tow line 111 may comprise metal. According to an embodiment, the first tow line 110 and/or the second tow line 111 may comprise nylon. According to an embodiment, the first tow line 110 and/or the second tow line 111 may comprise synthetic polymer. According to an embodiment, the first tow line 110 and/or the second tow line 111 may comprise combinations of materials, such as, for example, at least two or more of: plastic, rope, metal, nylon, synthetic polymer, combinations thereof, and/or the like.

A first shock absorber 112 and a second shock absorber 113 may be substantially similar. Substantially similar means that the first shock absorber 112 and/or the second shock absorber 113 may appear identical and/or may be complimentary pieces with respect to shape, dimension, size, and/or material. Substantially similar may mean the first shock absorber 112 and/or the second shock absorber 113 may operate in a similar capacity within the overall apparatus 100. The first shock absorber 112 may transfer counteracting forces exhibited from the first end portion 103 of the spar 101 to the first side 114 of the movable structure 107. The second shock absorber 113 may transfer counteracting forces exhibited from the second end portion 104 of the spar 101 to the second side 115 of the movable structure 107. The first shock absorber 112 and/or the second shock absorber 113 may comprise a material configured to bear the counteracting forces from the spar 101.

According to an embodiment, the first shock absorber 112 and/or the second shock absorber 113 may comprise a multi-tube structure, for example a twin-tube structure. Twin-tube means that a shock absorber may comprise an outer tube and an inner tube. According to an embodiment, the first shock absorber 112 and/or the second shock absorber 113 may comprise a mono-tube structure. Mono-tube means that a shock absorber may comprise one tube. A tube may comprise different cross-sectional shapes, such as, for example, a round cross-sectional shape, a rectangular cross-sectional shape, a triangular cross-sectional shape, or any similar cross-sectional shape.

Figure 2:
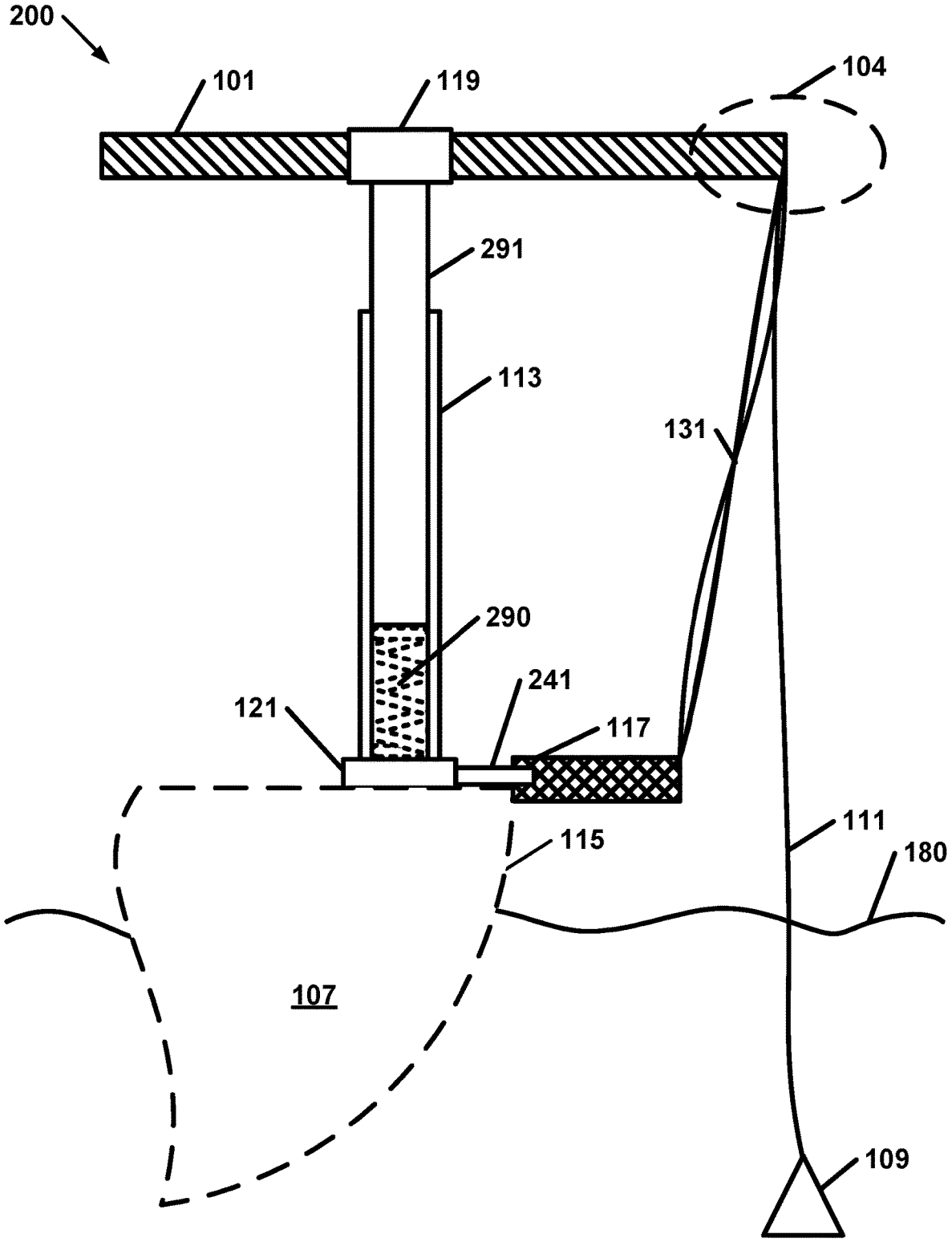
FIG. 2 illustrates a cross-sectional view of a shock absorber according to an aspect of an example embodiment of the present disclosure.

FIG. 2 illustrates a cross-sectional view of a shock absorber according to an aspect of an example embodiment of the present disclosure. A piston 291, or similar device, may increase and decrease the pressure of a chamber 290 within a shock absorber 113 in an apparatus 200. According to an embodiment, the first shock absorber 112 and/or the second shock absorber 113 may comprise hydraulics. Hydraulics may enable a shock absorber to use one or more fluids to absorb and/or dampen shock impulses. According to an embodiment, the first shock absorber 112 and/or the second shock absorber 113 may comprise an internal spring. An internal spring may comprise at least one spring, coil, and/or similar device. An internal spring may be employed to absorb and/or dampen shock impulses. According to an embodiment, the first shock absorber 112 and/or the second shock absorber 113 may comprise pneumatics. Pneumatics may enable a shock absorber to use one or more gases to absorb and/or dampen shock impulses. The first shock absorber 112 and/or the second shock absorber 113 may employ other devices to absorb and/or dampen shock impulses. For example, according to an embodiment, the first shock absorber 112 and/or the second shock absorber 113 may comprise torsion bars. According to an embodiment, the first shock absorber 112 and/or the second shock absorber 113 may comprise electromagnetic suspensions. According to an embodiment, the first shock absorber 112 and/or the second shock absorber 113 may comprise air bag suspensions. According to an embodiment, the first shock absorber 112 and/or the second shock absorber 113 may comprise one or more pistons. According to an embodiment, the first shock absorber 112 and/or the second shock absorber 113 may comprise combinations of devices that may absorb and/or dampen shock impulses, such as, for example: a twin-tube structure, a mono-tube structure, hydraulics, pneumatics, an internal spring, torsion bars, electromagnetic suspensions, air bag suspensions, one or more pistons, combinations thereof, and/or the like.

Figure 3:
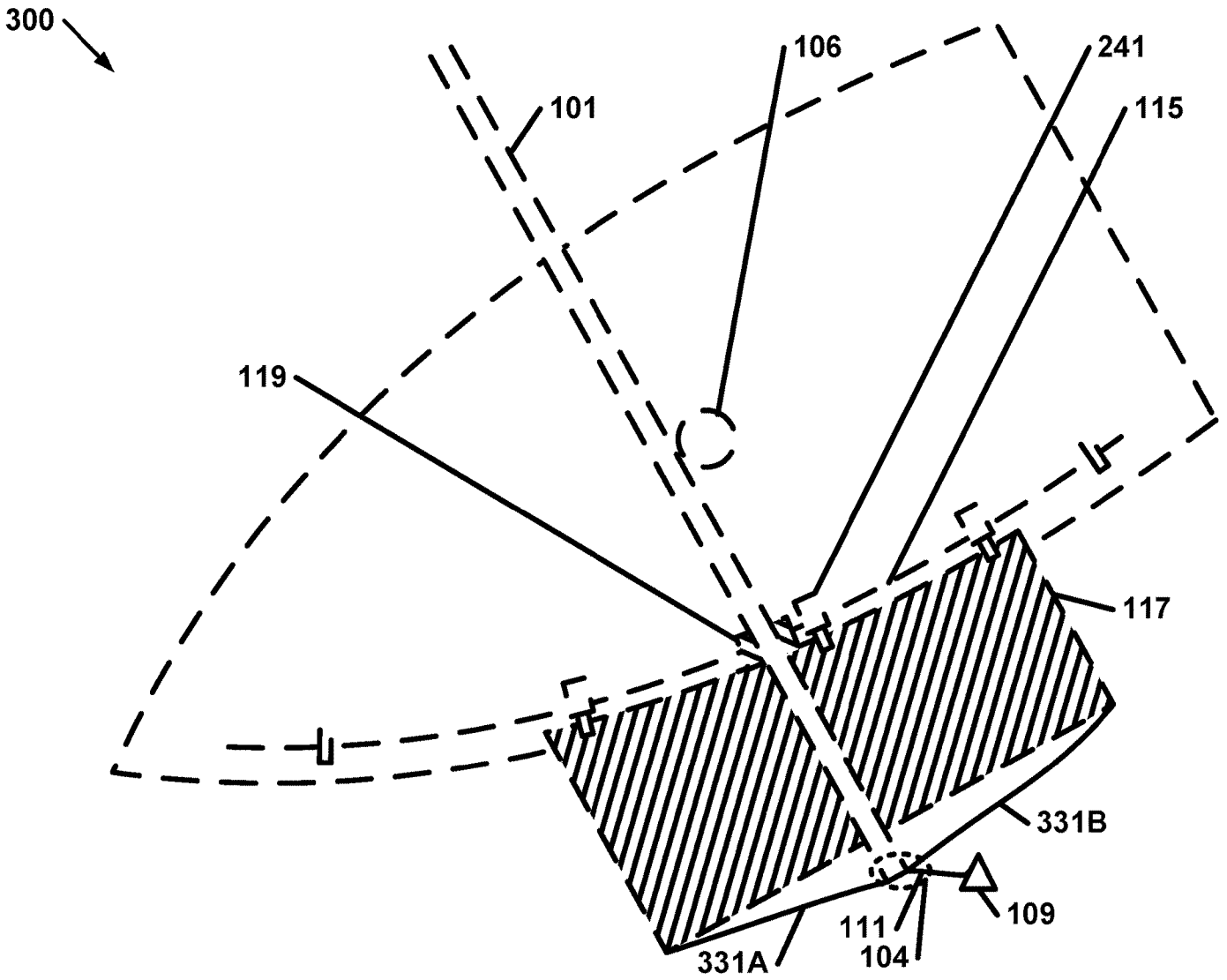
FIG. 3 illustrates a top view of an aspect of an example embodiment of the present disclosure.

The movable structure 107 may comprise an elongated member 106. According to an embodiment, the elongated member 106 may comprise a mast, or similar structure, that extends up from, through, or near, the deck of the watercraft. FIG. 3 illustrates a top view of an aspect of an example embodiment 300 of the present disclosure. According to an embodiment, the spar 101 may be perpendicular in relation to the elongated member 106. The term perpendicular means the elongated member 106 and the spar 101 intersect at, or near, a right angle. For example, according to an embodiment, the elongated member 106 and the spar 101 may intersect between −10 and +10 degrees. For example, according to an embodiment, the elongated member 106 and the spar 101 may intersect between −5 and +12 degrees. According to some embodiments, the spar 101 may be configured to be movable from a pure perpendicular position. This movement may be based on external effects such as sail positions, sail weight distributions, wind pressure, weight of objects attached to the spar 101, structure of a connector that connects the spar 101 to the elongated member 106, and/or the like.

According to an embodiment, the apparatus 100 may comprise a first platform 116 and/or a second platform 117. The first platform 116 and the second platform 117 may be substantially similar. Substantially similar means that the first platform 116 and/or the second platform 117 may appear identical and/or may be complimentary with respect to shape, dimension, size, and/or material. Substantially similar may mean the first platform 116 and/or the second platform 117 may operate in a similar capacity within the overall apparatus 100. The first platform 116 may connect to the first side 114 of the movable structure 107. The first platform 116 may connect to the first end portion 103 of the spar 101 via a first stabilizing line(s) 130. The second platform 117 may connect to the second side 115 of the movable structure 107. The second platform 117 may connect to the second end portion 104 of the spar 101 via a second stabilizing line(s) 131.

Figure 4:
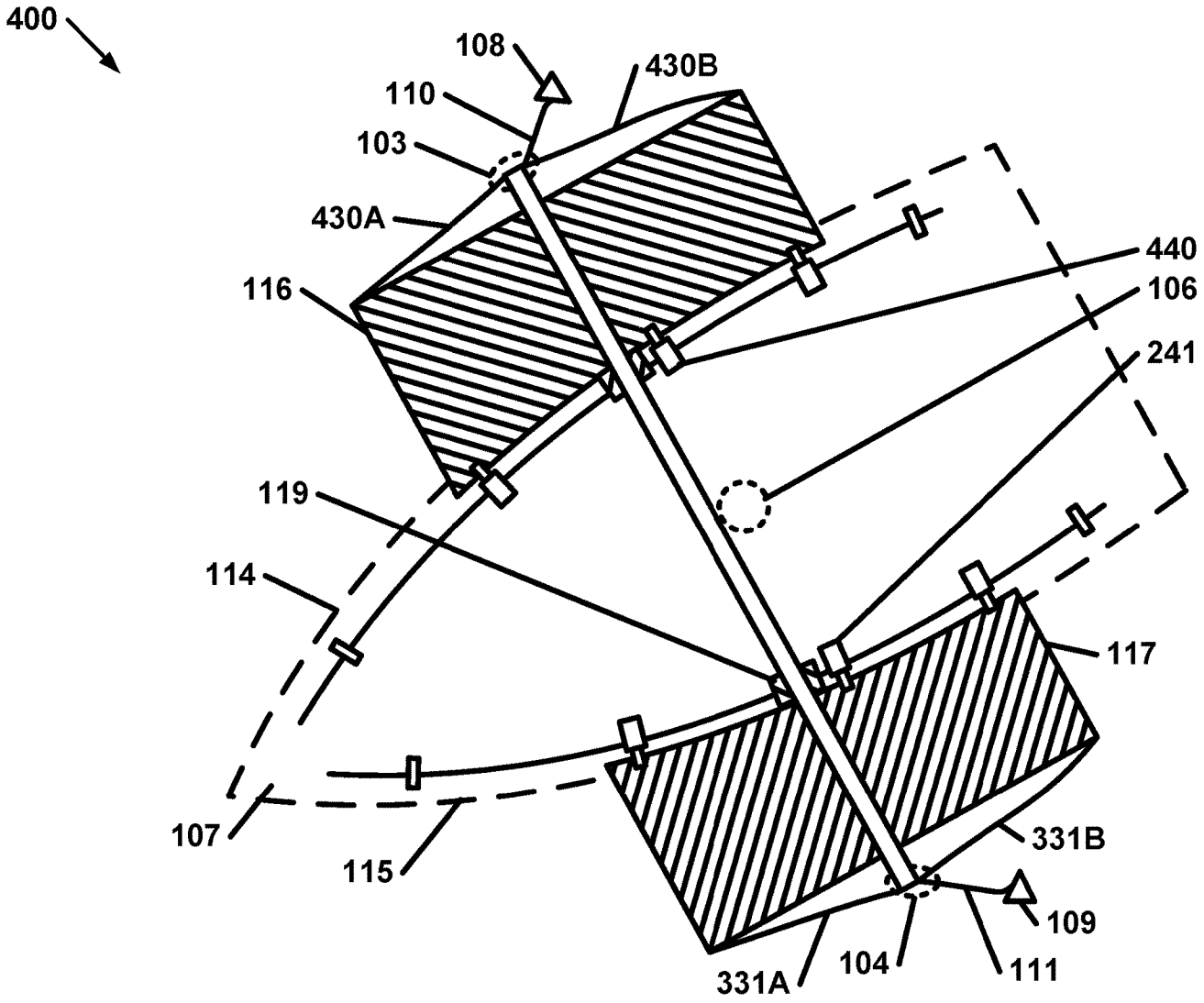
FIG. 4 illustrates a top view of an aspect of an example embodiment of the present disclosure.

FIG. 4 illustrates a top view of an aspect of an example embodiment 400 of the present disclosure. According to an embodiment, a first platform 116 may connect to a stanchion 440, or similar device, attached to the first side 114 of the movable structure 107. According to an embodiment, a second platform 117 may connect to a stanchion 241, or similar device, attached to the second side 115 of the movable structure 107. A stanchion (e.g. 440 and/or 241) may comprise a device configured to secure a platform (e.g. 116 and/or 117) to a side (e.g. 114 and/or 115) of a movable structure (e.g. 107). According to an embodiment, a stanchion (e.g. 440 and/or 241) may comprise a device configured to attach to the outer portion of the first side 114 of the movable structure 107 and/or the second side 115 of the movable structure 107. According to an embodiment, a stanchion (e.g. 440 and/or 241) may comprise a device configured to attached to the gunwale, or similar edge, portion of the first side 114 of the movable structure 107 and/or the second side 115 of the movable structure 107. According to an embodiment, a stanchion (e.g. 440 and/or 241) may comprise a device configured to attach to the railing portion of the first side 114 of the movable structure 107 and/or the second side 115 of the movable structure 107. According to an embodiment, a stanchion (e.g. 440 and/or 241) may comprise a device configured to attach to the deck portion of the first side 114 of the movable structure 107 and/or the second side 115 of the movable structure 107.

A first platform 116 may provide additional storage space for the first side 114 of the movable structure 107. A second platform 117 may provide additional storage space for the second side 115 of the movable structure 107. The first platform 116 may comprise a material configured to bear the weight of stored object(s) on the first side 114 of the movable structure 107. The second platform 117 may comprise a material configured to bear the weight of stored object(s) on the second side 115 of the movable structure 107. According to an embodiment, the first platform 116 and/or the second platform 117 may comprise canvas. According to an embodiment, the first platform 116 and/or the second platform 117 may comprise polymer material. According to an embodiment, the first platform 116 and/or the second platform 117 may comprise plastic. According to an embodiment, the first platform 116 and/or the second platform 117 may comprise fabric. According to an embodiment, the first platform 116 and/or the second platform 117 may comprise metal. According to an embodiment, the first platform 116 and/or the second platform 117 may comprise rubber. According to an embodiment, the first platform 116 and/or the second platform 117 may comprise wood. According to an embodiment, the first platform 116 and/or the second platform 117 may comprise carbon fiber. According to an embodiment, the first platform 116 and/or the second platform 117 may comprise combinations of materials, such as, for example, at least two or more of: canvas, polymer material, plastic, fabric, metal, rubber, wood, carbon fiber, combinations thereof, and/or the like.

According to an embodiment, the first stabilizing line(s) (e.g. 130) may comprise a first line 430A. According to an embodiment, the first stabilizing line(s) (e.g. 130) may comprise a first line 430A and a second line 430B. According to an embodiment, the first stabilizing line(s) (e.g. 130) may comprise more than two lines. According to an embodiment, the second stabilizing line(s) (e.g. 131) may comprise a first line 331A. According to an embodiment, the second stabilizing line(s) (e.g. 131) may comprise a first line 331A and a second line 331B. According to an embodiment, the second stabilizing line(s) (e.g. 131) may comprise more than two lines.

First stabilizing line(s) (e.g. 130) may comprise a material configured to bear the weight of the first platform 116 without breaking or fraying. Second stabilizing line(s) (e.g. 131) may comprise a material configured to bear the weight of the second platform 117 without breaking or fraying. According to an embodiment, the first stabilizing line(s) (e.g. 130) and/or the second stabilizing line(s) (e.g. 131) may comprise plastic. According to an embodiment, the first stabilizing line(s) (e.g. 130) and/or the second stabilizing line(s) (e.g. 131) may comprise rope. According to an embodiment, the first stabilizing line(s) (e.g. 130) and/or the second stabilizing line(s) (e.g. 131) may comprise metal. According to an embodiment, the first stabilizing line(s) (e.g. 130) and/or the second stabilizing line(s) (e.g. 131) may comprise nylon. According to an embodiment, the first stabilizing line(s) (e.g. 130) and/or the second stabilizing line(s) (e.g. 131) may comprise polymer material. According to an embodiment, the first stabilizing line(s) (e.g. 130) and/or the second stabilizing line(s) (e.g. 131) may comprise combinations of materials, such as, for example, at least two or more of: plastic, rope, metal, nylon, polymer material, combinations thereof, and/or the like.

According to an embodiment, the spar 101 may be long enough for the first end portion 103 to extend over the first side 114 of the movable structure 107. According to an embodiment, the spar 101 may be long enough for the second end portion 104 to extend over the second side 115 of the movable structure 107. According to an embodiment, the extent of the overhang may allow the first resistance device 108 and/or the second resistance device 109 to interact with the external force(s).

According to an embodiment, the apparatus 100 may comprise a brace 174. The brace 174 may be attached to the elongated member 106 of the movable structure 107. The brace 174 may connect to the central portion 102 of the spar 101. The brace 174 may secure the spar 101 to the elongated member 106, providing additional stability to the apparatus 100 in relation to the movable structure 107. According to an embodiment, the brace 174 may comprise metal. According to an embodiment, the brace 174 may comprise plastic. According to an embodiment, the brace 174 may comprise polymer material. According to an embodiment, the brace 174 may comprise rubber. According to an embodiment, the brace 174 may comprise wood. According to an embodiment, the brace 174 may comprise carbon fiber. According to an embodiment, the brace 174 may comprise combinations of materials, such as, for example, at least two or more of: metal, plastic, polymer material, rubber, wood, carbon fiber, combinations thereof, and/or the like.

According to an embodiment, the brace 174 may comprise stagnant components. Stagnant means that the brace 174 may comprise one or more components that are configured to avoid moving with spar 101 movements. According to an embodiment, the brace 174 may comprise movable components. Movable means that the brace 174 comprises one or more components that are configured to change position with the spar 101 movements.

According to an embodiment, the apparatus 100 may comprise a first attachment cuff 118 and/or a second attachment cuff 119. The first attachment cuff 118 and the second attachment cuff 119 may be substantially similar. Substantially similar means that the first attachment cuff 118 and/or the second attachment cuff 119 may appear identical and/or may be complimentary with respect to shape, dimension, size, and/or material. Substantially similar may mean the first attachment cuff 118 and/or the second attachment cuff 119 may operate in a similar capacity within the overall apparatus 100. The first attachment cuff 118 may attach between the first end portion 103 and the central portion 102 of the spar 101. The first attachment cuff 118 may attach to the first shock absorber 112. The second attachment cuff 119 may attach between the second end portion 104 and the central portion 102 of the spar 101. The second attachment cuff 119 may attach to the second shock absorber 113. The first attachment cuff 118 may secure the spar 101 to the first shock absorber 112. The second attachment cuff 119 may secure the spar 101 to the second shock absorber 113.

According to an embodiment, the first attachment cuff 118 and/or the second attachment cuff 119 may comprise metal. According to an embodiment, the first attachment cuff 118 and/or the second attachment cuff 119 may comprise plastic. According to an embodiment, the first attachment cuff 118 and/or the second attachment cuff 119 may comprise a polymer material. According to an embodiment, the first attachment cuff 118 and/or the second attachment cuff 119 may comprise rubber. According to an embodiment, the first attachment cuff 118 and/or the second attachment cuff 119 may comprise wood. According to an embodiment, the first attachment cuff 118 and/or the second attachment cuff 119 may comprise carbon fiber. According to an embodiment, the first attachment cuff 118 and/or the second attachment cuff 119 may comprise combinations of materials, such as, for example, at least two or more of: metal, plastic, polymer material, rubber, wood, carbon fiber, combinations thereof, and/or the like.

According to an embodiment, the apparatus 100 may comprise a first attachment pad 120 and/or a second attachment pad 121. The first attachment pad 120 and the second attachment pad 121 may be substantially similar. Substantially similar means that the first attachment pad 120 and/or the second attachment pad 121 may appear identical and/or may be complimentary with respect to shape, dimension, size, and/or material. Substantially similar may mean the first attachment pad 120 and/or the second attachment pad 121 may operate in a similar capacity within the overall apparatus 100. The first attachment pad 120 may connect to the first shock absorber 112. The first attachment pad 120 may connect to the first side 114 of the movable structure 107. The second attachment pad 121 may connect to the second shock absorber 113. The second attachment pad 121 may connect to the second side 115 of the movable structure 107. The first attachment pad 120 may secure the first shock absorber 112 to the first side 114 of the movable structure 107. The first attachment pad 120 may reduce an external force(s) from the first shock absorber 112 to the first side 114 of the movable structure 107. The second attachment pad 121 may secure the second shock absorber 113 to the second side 115 of the movable structure 107. The second attachment pad 121 may reduce an external force(s) from the second shock absorber 113 to the second side 115 of the movable structure 107.

According to an embodiment, the first attachment pad 120 and/or the second attachment pad 121 may comprise metal. According to an embodiment, the first attachment pad 120 and/or the second attachment pad 121 may comprise plastic. According to an embodiment, the first attachment pad 120 and/or the second attachment pad 121 may comprise polymer material. According to an embodiment, the first attachment pad 120 and/or the second attachment pad 121 may comprise rubber. According to an embodiment, the first attachment pad 120 and/or the second attachment pad 121 may comprise wood. According to an embodiment, the first attachment pad 120 and/or the second attachment pad 121 may comprise carbon fiber. According to an embodiment, the first attachment pad 120 and/or the second attachment pad 121 may comprise fabric. According to an embodiment, the first attachment pad 120 and/or the second attachment pad 121 may comprise combinations of materials, such as, for example, at least two or more of: metal, plastic, polymer material, rubber, wood, carbon fiber, fabric, combinations thereof, and/or the like.

In the figures, certain elements (e.g. movable structure 107, and elongated member 106) in this disclosure are shown in dashes. These dashed elements (e.g. movable structure 107, and elongated member 106) are shown for illustrative purposes to show how claimed elements of the embodiments of this disclosure may be configured to connect to these dashed elements. Additional embodiments may include one or more of the dashed elements. Elements with identical numbers in the figures are shown to represent similar structures between the embodiments. However, each figure in the disclosure may represent a separate embodiment.

In this disclosure, "a" and "an" and similar phrases are to be interpreted as "at least one" or "one or more." Similarly, any term that ends with the suffix "(s)" is to be interpreted as "at least one" or "one or more." In this disclosure, the term "may" is to be interpreted as "may, for example." In other words, the term "may" is indicative that the phrase following the term "may" is an example of one of a multitude of suitable possibilities that may, or may not, be employed to one or more of the various embodiments. The phrase "based on" is indicative that the phrase following the term "based on" is an example of one of a multitude of suitable possibilities that may, or may not, be employed to one or more of the various embodiments. The phrase "in response to" is indicative that the phrase following the phrase "in response to" is an example of one of a multitude of suitable possibilities that may, or may not, be employed to one or more of the various embodiments. The terms "including" and "comprising" should be interpreted as meaning "including, but not limited to." In this disclosure, the abbreviation "e.g." means "for example" and is followed by one or more examples that illustrate a term receding the abbreviation.

In this disclosure, various embodiments are disclosed. Limitations, features, and/or elements from the disclosed example embodiments may be combined to create further embodiments within the scope of the disclosure.

Furthermore, many features presented above are described as being optional through the use of "may" or the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purposes required by law, but otherwise reserves all copyright rights whatsoever.

While various embodiments have been described above, it should be understood that they have been presented by way of example, and not limitation. It will be apparent to persons skilled in the relevant art(s) that various changes in form and detail can be made therein without departing from the scope. In fact, after reading the above description, it will be apparent to one skilled in the relevant art(s) how to implement alternative embodiments. Thus, the present embodiments should not be limited by any of the above-described exemplary embodiments. In particular, it should be noted that, for example purposes, the above explanation has focused on stabilizing rolling effects on a watercraft. However, one skilled in the art will recognize that embodiments of the invention may also be able to reduce the effects of rolling on different structures such as, for example, the rolling effects on a floating platform, unmanned aerial vehicles, combinations thereof, and/or the like.

In addition, it should be understood that any figures which highlight the functionality and advantages, are presented for example purposes only. The disclosed architecture is sufficiently flexible and configurable, such that it may be utilized in ways other than that shown. For example, the actions listed in any flowchart may be re-ordered or only optionally used in some embodiments.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

Finally, it is the applicant's intent that only claims that include the express language "means for" or "step for" be interpreted under 35 U.S.C. 112. Claims that do not expressly include the phrase "means for" or "step for" are not to be interpreted under 35 U.S.C. 112.

What is claimed is:

1. An apparatus comprising:
a) a spar comprising:
i) a central portion;
ii) a first end portion;
iii) a second end portion;
b) a first resistance device;
c) a second resistance device;
d) a first tow line connected between:
i) the first end portion; and
ii) the first resistance device;
e) a second tow line connected between:
i) the second end portion; and
ii) the second resistance device;
f) a first shock absorber configured to connect:
i) between the first end portion and the central portion; and
ii) a first side of a movable structure; and
g) a second shock absorber configured to connect:
i) between the second end portion and the central portion; and
ii) a second side of the movable structure.

2. The apparatus set forth in claim 1, further comprising an elongated member.

3. The apparatus set forth in claim 1, further comprising a first platform configured to connect to:
a) the first side of the movable structure; and
b) the first end portion via first stabilizing lines.

4. The apparatus set forth in claim 2, further comprising a second platform configured to connect to:
a) the second side of the movable structure; and
b) the second end portion via second stabilizing lines.

5. The apparatus set forth in claim 1, wherein the spar comprises a continuous beam.

6. The apparatus set forth in claim 1, wherein the spar comprises multiple beams.

7. The apparatus set forth in claim 2, wherein the spar is positioned perpendicular to the elongated member.

8. The apparatus set forth in claim 2, further comprising a brace configured to attach to:
a) the elongated member of the movable structure; and
b) the central portion.

9. The apparatus set forth in claim 8, wherein the brace comprises stagnant components.

10. The apparatus set forth in claim 8, wherein the brace comprises movable components.

11. The apparatus set forth in claim 1, wherein the first shock absorber comprises an internal spring.

12. The apparatus set forth in claim 1, wherein the first shock absorber comprises hydraulics.

13. The apparatus set forth in claim 1, wherein the first shock absorber comprises pneumatics.

14. The apparatus set forth in claim 1, wherein the second shock absorber comprises an internal spring.

15. The apparatus set forth in claim 1, wherein the second shock absorber comprises hydraulics.

16. The apparatus set forth in claim 1, wherein the second shock absorber comprises pneumatics.

17. The apparatus set forth in claim 1, wherein the first shock absorber is connected between:
a) the first end portion; and
b) the central portion via a first attachment cuff.

18. The apparatus set forth in claim 17, wherein the second shock absorber is connected between:
a) the second end portion; and
b) the central portion via a second attachment cuff.

19. The apparatus set forth in claim 1, wherein the first shock absorber is configured to connect to the first side of the movable structure via a first attachment pad.

20. The apparatus set forth in claim 19, wherein the second shock absorber is configured to connect to the second side of the movable structure via a second attachment pad.

* * * * *